United States Patent [19]

Rymarchyk

[11] 4,245,824

[45] Jan. 20, 1981

[54] CHUTE FOR CHARGING VESSELS

[75] Inventor: Nicholas M. Rymarchyk, Wexford, Pa.

[73] Assignee: Pullman Berry, Harmony, Pa.

[21] Appl. No.: 973,829

[22] Filed: Dec. 28, 1978

[51] Int. Cl.[3] ..... C21C 7/00

[52] U.S. Cl. ..... 266/287; 266/216

[58] Field of Search ..... 266/287, 216

[56] References Cited

U.S. PATENT DOCUMENTS 3,823,929 7/1974 Rymarchyk et al. ..... 266/287

*Primary Examiner*—R. Dean

*Attorney, Agent, or Firm*—Richard J. Myers

[57] ABSTRACT

A water cooled material additive chute for introducing fluxing material into a steel furnace includes water cooled inlet and outlet chambers meeting at a tip or nose portion which includes deflectors adapted to increase the cooling efficiency of the water coolant and includes a pipe structure which accommodates thermal expansion.

14 Claims, 5 Drawing Figures

4
5
16
17
21
22
23
24
25
26
29
30
31
32
32'
33
34
35
36
37
38
39
40
41
42
43
43'
44
45
46
47
48
49
50
51
52
53

CHUTE FOR CHARGING VESSELS

BACKGROUND OF THE INVENTION

1. Field of the Invention

Broadly the invention concerns furnace operations and more particularly an additive chute for introducing fluxing materials or the like into a furnace.

2. Description of the Prior Art

In steel making operations, it has been common to fabricate additive flux chutes which include an internal additive tube surrounded by a larger tube including a water cooling chamber. Typically, the top and nose portions of the chute would include annular plates sealing the ends of concentric water inlet and outlet pipes welded within the arrangement such that cooling water could be moved through the chamber to cool the chute during furnace operations. However, it has been the applicant's experience that heat transfer to the cooling fluids within the chute construction heretofore known must be very closely monitored and controlled; and further, because of the high temperatures to which the chute must necessarily be subjected, the rigid welded constructions of the prior art have developed leaks or fractures resulting from thermal and mechanical stresses in the welds due to thermal expansion of the various elements of the chute. The present arrangement overcomes these difficulties and, thus, substantially enhances the safe operation, maintainability and service life over the construction of the prior art.

SUMMARY OF THE INVENTION

In the present invention the additive chute design includes an upper tubular portion which receives material such as lime or other fluxes that have to be added to a furnace vessel during its operation. A conventional gate is provided at the top through which material may be delivered to the upper tubular portion of the chute which in turn is connected to a first tubular chute portion and to a second tubular chute portion. The additive chute includes three removable sections which are readily removed for service. A first chute portion includes a first upper tube or pipe assembly including a first upper outer pipe and a first inner pipe spaced radially therefrom to provide a water inlet chamber and communication with a water inlet pipe. The lower end of the first pipe assembly includes a flange which is adapted to be easily connected and disconnected to a second lower flange of the second lower pipe assembly comprising the second chute portion. The second lower tube pipe assembly comprises an outer tube and an inner tube or pipe separated by means of an intermediate pipe which divides the space between the lower pipes into a water chamber in communication with the upper water chamber and a water outlet chamber which is suitably connected to a water outlet pipe. The flange connection of the upper and lower chute portions has positioned therebetween in clamping relation an intermediate flange which is sealingly connected between the upper flanges and lower flanges of the respective first and second tube portions. The intermediate flange also provides the closure or isolating means for separating the water discharge chamber at its upper end from the water inlet chamber. The intermediate pipe extends downwardly and includes an enlarged end portion or deflector closely and critically spaced from the arcuate nose or tip portions of the additive chute to promote high velocity flow and directing of cooling water between the inlet and outlet chambers in the proximity of the tip and thus enhance cooling therewithin. The invention further provides that the inner upper and lower pipes be in relatively slip jointed overlapping relation and suitably sealed to effectively accommodate longitudinal expansion and contraction of the chute members during use.

DESCRIPTION OF THE PREFERRED EMBODIMENT

Figure 1:
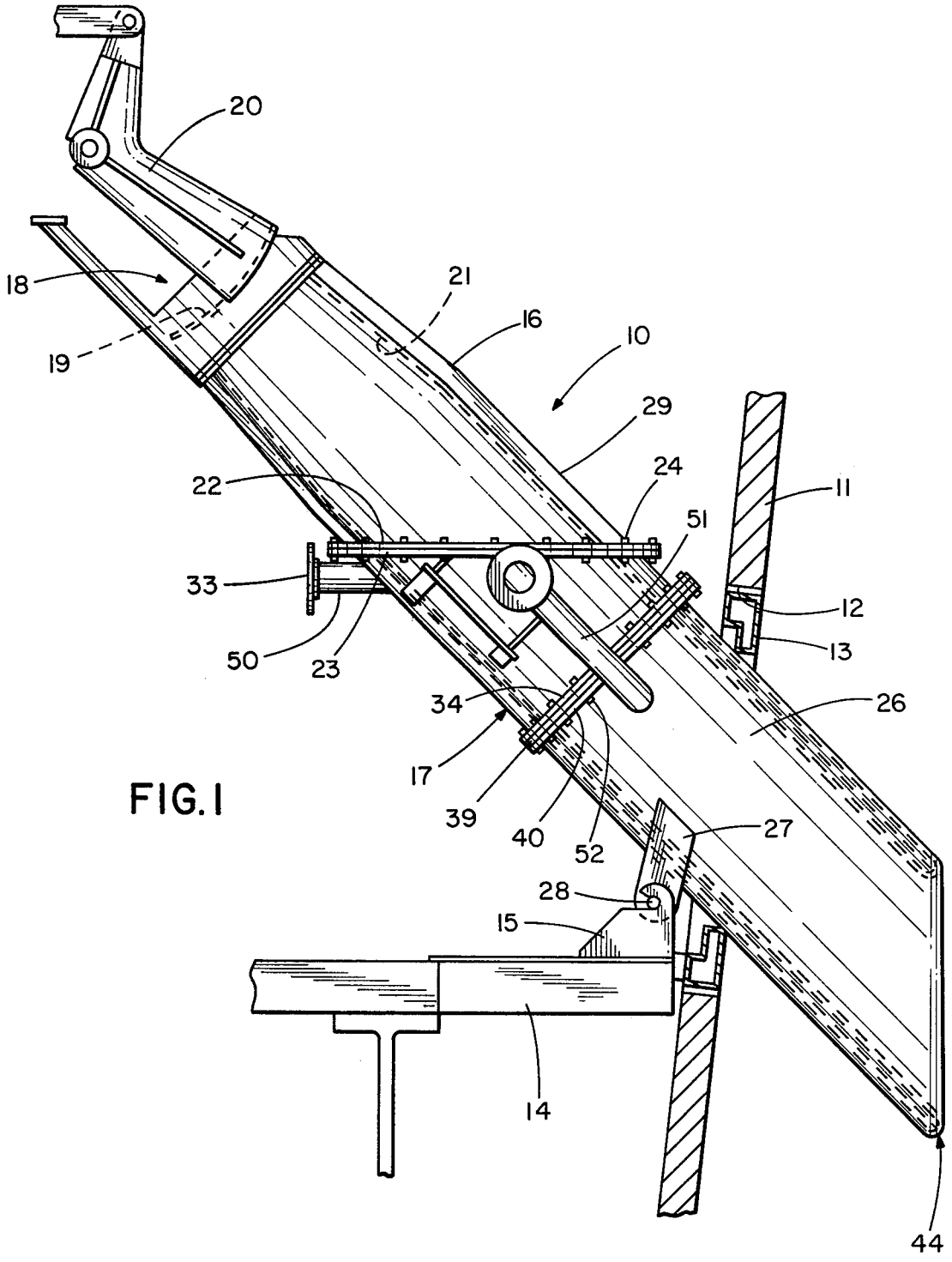
FIG. 1 is a side elevational view of an additive chute supported in charging relation relative to a wall portion of a steel making vessel.

As particularly shown in FIG. 1 a furnace and additive charging chute 10 is shown in charging relation projecting through the wall 11 of a steel making vessel in opening 12 supporting an additive chute adaptor panel 13 through which the chute 10 projects. The charging chute 10 includes an upper first chute portion 16 and a lower second chute portion 17. The upper end of the chute 10 is provided with a conventional charging opening 18 adapted to be controlled by a hinged gate 19 by gate opening and closing mechanism 20 in conventional manner. The first chute portion 16 includes a tubular inner wall 21 provided at its lower end with a flange 22 connected to a flange 23 by quick disconnect bolts and nuts 24. The flange 23 is connected to the upper end of a first upper pipe assembly 25 which is connected as will be described to a second lower pipe 26. As best shown in FIG. 1 a floor ramp 14 is provided with hinge brackets 15 which hingedly support hinge brackets 27 including hinge pins 28 whereby the additive chute may be raised and lowered as desired for removal.

Figures 2, 3:
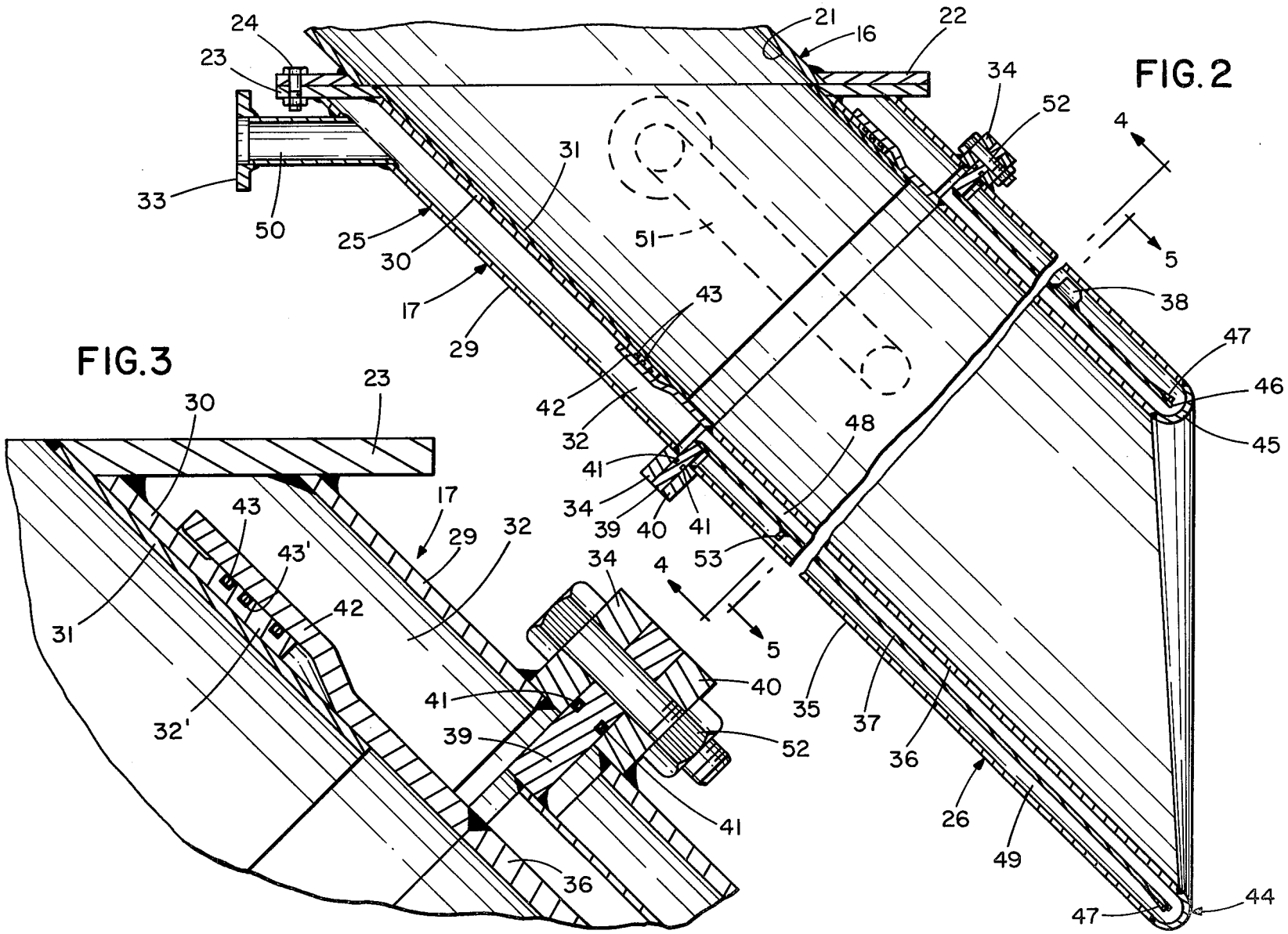
FIG. 2 is a cross-sectional view through a portion of an additive chute shown in FIG. 1.
FIG. 3 is an enlarged cross-sectional view of a portion of the chute showing the connection between upper and lower chute portions.
Figure 4:
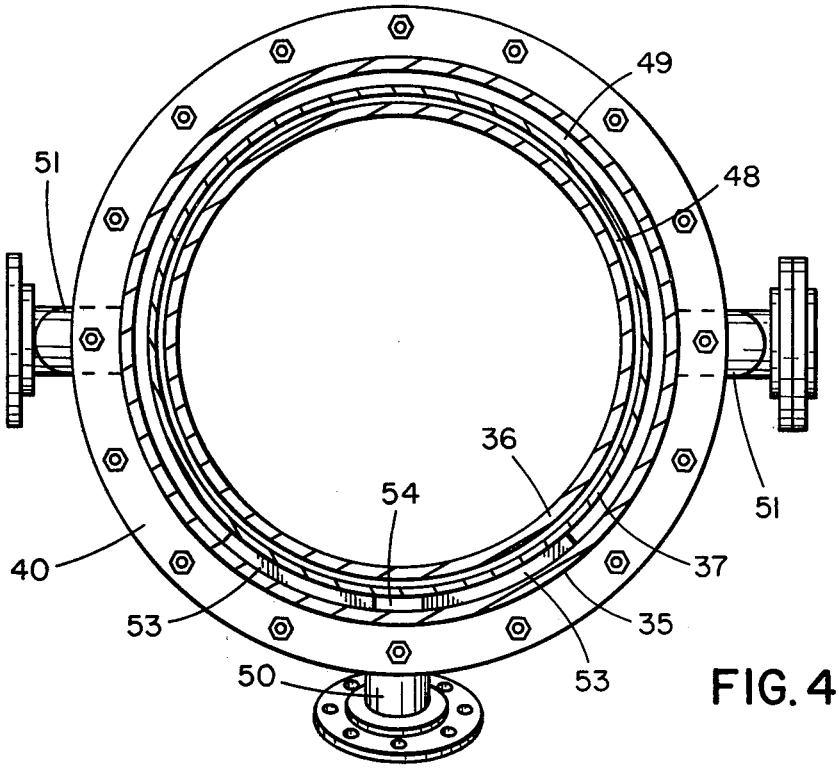
FIG. 4 is a cross-sectional view taken substantially along the lines 4—4 of FIG. 1.
Figure 5:
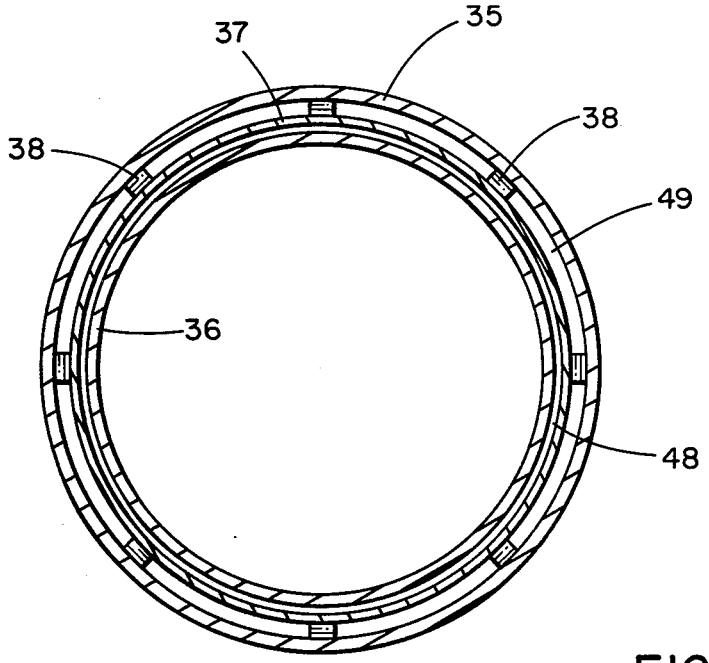
FIG. 5 is a cross-sectional view taken substantially along lines 5—5 of FIG. 2.

The first upper pipe assembly 25 includes a first upper pipe 29 and a second upper pipe 30 spaced radially inwardly from the first upper pipe to provide a space therebetween which comprises an upper water chamber 32. An inner sleeve 31 as best shown in FIG. 2 is rigidly secured to the pipe 30 and projects slightly below the lower end thereof. A water inlet pipe connection 33 projects outwardly from the first upper pipe for supplying water to the upper water inlet chamber 32. The first upper pipe 29 is provided in its lower end with a lower flange 34. The second lower pipe assembly 26 includes a first lower pipe 35 and a second lower pipe 36 spaced radially inwardly therefrom. An intermediate pipe 37 is spaced substantially radially midway between the pipes 35 and 36 and includes a plurality of spacers 38. An intermediate flange 39 is connected to the upper ends of the pipes 35 and 37. A plurality of seals 41 as best shown in FIG. 3 are disposed on suitable grooves for effectively sealing the flanged connection by means of quickly removable bolt and nut connections. As best shown in FIG. 3 the pipe 36 is provided at its upper end with an extension 42 which is in an overlapping relation with respect to a lower end piston portion 32' of the pipe 30. The piston portion 32' comprises a plurality of annular grooves 43' within which O-rings 43 are provided. As shown in the drawings the lower end of the inner sleeve 31 projects downwardly beyond the piston portion 32' in overlapping relation with respect to the lower portion of the extension 42.

The tip of the chute is generally designated at 44 and includes an arcuate wall 45 which extends in oblique relationship with respect to a vertical plane through said additive chute. The intermediate wall 37 projects downwardly in spaced relation as indicated at 46 to end shortly above the arcuate wall of the tip 44. The lower end of the intermediate wall 37 also is provided adjacent to the end 46 with a plurality of circumferentially spaced outwardly projecting vanes or deflectors 47 to promote high velocity flow in the proximity of the tip as noted above. The intermediate wall 37 provides with the wall 36 a lower inlet water chamber 48 and a water discharge chamber 49 which discharges cooling water through an outlet pipe 51. Two of such pipes are shown but if it is desired one may be capped and the other may be utilized. Additionally, to adjust and direct the flow of coolant water through the discharge chamber 49, spaced baffles 53 defining an opening 54 are provided which in turn promote circulation in the interior of the tip.

OPERATION

FIG. 1 discloses the additive chute in position for charging lime or other fluxes and materials into the furnace as desired. The loading is conventional and material fed into the chute is directed immediately downwardly therethrough into the furnace. In the event that the chute has to be repaired it can be lowered from the position shown in FIG. 1 on to the ramp 14 and thereupon removed from the site for suitable repairs as necessary. The present chute is easily repaired since it can readily be disassembled by the quick disconnect bolt arrangement provided by the flanged connections 22, 23, 34, 39 and 40. In operation water is fed into the water inlet chamber 32 through the inlet pipe 50 where it is directed into the chamber 48 and around the lower end 46 of the intermediate wall and deflectors 47 and through the water outlet chamber 49 to the discharge pipes 51. The intermediate flange 39 serves to divert the water into the chamber 48 and isolates the chamber 49 from which the water is discharged so that a continual water flow is maintained while providing for high turbulence and velocity in the proximity of the tip portion 44 to enhance cooling thereof. Additionally, it should be specifically noted that by virtue of the novel slip joint arrangement provided by the extension 42 overlapping the seals 43 and piston portion 32', the chute accommodates relative thermal expansion, thus abating the development of leaks or fractures in the welds.

From the above, it can be seen that the chute construction of the present invention is easily reparable and thus provides for reduced down time and the directed flow of coolant through the chute enhances extraction of heat from the exterior shell and nose or tip of the chute to abate the development of thermally induced stresses. The present construction also essentially obviates the development of water zones within the coolant chamber which could lead to failure or rupture of the chute arrangement due to localized hot spots or regions therein. As noted above, this is accomplished in the present arrangement by critically positioning the deflectors 47 in the lower end of the tip so as to increase the velocity and turbulence of the coolant flow at the curved portion 45 of the tip as well as by the baffles 53 which further assure controlled and optimum cooling of the chute.

What is claimed is:

1. A chute for conveying materials into a vessel containing a molten bath including a first tubular chute portion having a material receiving opening, a liquid cooled second chute communicating with said first chute, said liquid cooled second chute having a first upper pipe assembly including a first upper pipe, a second upper pipe positioned within said first upper pipe in radially spaced relation providing an annular first water inlet chamber, a water inlet connection for said first inlet chamber, a second lower pipe assembly including a first lower pipe, a second lower pipe positioned within said first lower pipe in radially spaced relation, an intermediate third pipe positioned between said first and second lower pipes, said third pipe providing with said first and second lower pipes a second water inlet chamber communicating with said first water inlet chamber, and a water outlet chamber isolated at its upper ends from said first water inlet chamber, an annular tip portion connected to the lower ends of said first and second lower pipes, said intermediate pipe having a lower portion thereat spaced from said tip providing communication between said second water inlet chamber and said water outlet chamber, a water outlet connection to said water outlet chamber, and coupling means releasably connecting said first and second pipe assemblies.

2. The chute in accordance with claim 1, said coupling means including an annular flange isolating said outlet chamber from said first water inlet chamber.

3. The chute in accordance with claim 1, said coupling means including a first annular flange on said first upper pipe, a second annular flange on said first lower pipe, an intermediate flange connected to said first lower and intermediate pipes, O'ring seals between said first and second annular flanges and said intermediate flange, and quick disconnect means connecting said flanges.

4. The chute in accordance with claim 1, said annular tip having an arcuate wall portion connecting the lower portions of said first and second lower pipes.

5. The chute in accordance with claim 4, said annular tip being disposed in oblique relation relative to a vertical plane disposed on the longitudinal axis of said chute.

6. The chute in accordance with claim 4, said lower portion of said intermediate wall projecting substantially close to the inner surface of said arcuate wall.

7. The chute in accordance with claim 4, said lower portion of said intermediate wall including a plurality of peripherally extending deflectors.

8. The chute in accordance with claim 7, said deflectors being positioned in said water outlet chamber.

9. The chute in accordance with claim 1, said second upper and lower pipes being positioned in overlapping slip joint relation.

10. The chute in accordance with claim 9, said overlapping pipes having sealing means disposed therebetween.

11. The chute in accordance with claim 1, wherein, said second upper and lower pipe assemblies being of substantially constant inside diameter throughout the length of said liquid cooled second chute.

12. The chute in accordance with claim 5, and, further coupling means for releasably connecting said first tubular chute with said liquid cooled second chute, said further coupling means being disposed in oblique relation relative to the longitudinal axis of said chute.

13. The chute in accordance with claim 1, and, supporting means for positioning said chute such that second lower pipe assembly extends through a wall of said vessel.

14. The chute in accordance with claim 13, wherein, said supporting means includes bracket means for releasably and pivotally supporting said chute.

* * * * *